US006869979B1

(12) United States Patent
Rich, Jr.

(10) Patent No.: US 6,869,979 B1
(45) Date of Patent: Mar. 22, 2005

(54) METHOD FOR PRODUCING ULTRA CLEAN LIQUID FUEL FROM COAL REFUSE

(76) Inventor: John W. Rich, Jr., R.D. #1, Box 211, Auburn, PA (US) 17922

( * ) Notice: Subject to any disclaimer, the term of this patent is extended or adjusted under 35 U.S.C. 154(b) by 117 days.

(21) Appl. No.: 10/259,683

(22) Filed: Sep. 27, 2002

Related U.S. Application Data

(60) Provisional application No. 60/325,596, filed on Sep. 28, 2001.

(51) Int. Cl.[7] ..... C07C 27/00

(52) U.S. Cl. ..... 518/715; 702/703; 702/704; 702/719

(58) Field of Search ..... 518/702, 703, 518/704, 715, 719

(56) References Cited

U.S. PATENT DOCUMENTS

| | | | | |
|---|---|---|---|---|
| 1,659,692 A | | 2/1928 | Kitchen | |
| 1,678,863 A | | 7/1928 | Kitchen | |
| 3,950,144 A | | 4/1976 | Gillette | 44/2 |
| 4,017,272 A | * | 4/1977 | Anwer et al. | 48/197 R |
| 4,039,425 A | | 8/1977 | Neavel | 208/8 |
| 4,153,427 A | | 5/1979 | Bissett et al. | 48/86 R |
| 4,193,554 A | | 3/1980 | Ansen et al. | 241/19 |
| 4,338,188 A | | 7/1982 | Guerre | 209/2 |
| 4,364,822 A | | 12/1982 | Rich, Jr. | 209/3 |
| 4,394,132 A | | 7/1983 | Taylor | 44/51 |
| 4,481,015 A | | 11/1984 | Lusch et al. | 48/202 |
| 4,484,928 A | | 11/1984 | Keller, Jr. | 44/1 SR |
| 4,604,105 A | | 8/1986 | Aquino et al. | 48/197 R |
| 4,753,660 A | | 6/1988 | Kellerwessel et al. | 44/51 |
| 4,762,526 A | | 8/1988 | Funaji et al. | 44/627 |
| 4,795,037 A | | 1/1989 | Rich, Jr. | 209/3 |
| 4,820,313 A | | 4/1989 | Kelmar | 44/622 |
| 4,913,068 A | | 4/1990 | Brannstrom | 110/342 |
| 5,085,764 A | | 2/1992 | Meyers et al. | 208/404 |
| 5,645,613 A | * | 7/1997 | Benham et al. | 44/452 |
| 6,015,104 A | | 1/2000 | Rich, Jr. | 241/20 |
| 6,170,770 B1 | | 1/2001 | Rich, Jr. | 241/81 |

OTHER PUBLICATIONS

"Coal–to–oil Plant May Go Up By 2003, Santorum Backs Benefits for Region", reprint from *The Pottsville (PA) Republican & evening Herald,* Nov. 2000.

"Projects to Develop Electricity/F–T Diesel Co–Production Plants Move Forward", reprint from *Hart's Gas–to–Liquids News,* Mar. 2001.

"His Energy Answer Lies in Coal Industry's Waste", reprint from *Philadelphia Inquirer,* Apr. 2001.

* cited by examiner

*Primary Examiner*—J. Parsa
(74) *Attorney, Agent, or Firm*—Howson and Howson

(57) ABSTRACT

The effective coupling and combination of coal gasification and coal liquefaction techniques to produce ultra clean liquid fuels from carbonaceous matter preferably provided from an abundance of waste coal mining material. The method and apparatus includes a final sulfur washing step utilizing a zinc oxide membrane to remove virtually all sulfur from synthetic gas produced in an entrained flow gasifier before the synthetic gas is permitted to enter a slurry phase vessel having a catalyst used to produce a parafin from which liquid fuel is produced. The liquid fuel is preferably an ultra clean, high cetane, sulfur-free diesel fuel.

5 Claims, 1 Drawing Sheet

METHOD FOR PRODUCING ULTRA CLEAN LIQUID FUEL FROM COAL REFUSE

CROSS REFERENCE TO RELATED APPLICATION

This application claims the benefit of priority of U.S. Provisional Patent Application No. 60/325,596 filed on Sep. 28, 2001.

FIELD OF THE INVENTION

The present invention relates to the combination and use of coal gasification and coal liquefaction techniques to produce ultra clean liquid fuels from carbonaceous matter, and more particularly, the present invention relates to a method of properly conditioning a coal gasification produced synthetic gas so that it can be effectively utilized in coal liquefaction equipment to produce ultra clean liquid fuel such as high cetane sulfur-free diesel fuel.

BACKGROUND OF THE INVENTION

Abandoned mine waste is abundant in most coal mining regions. For example, it was reported that Pennsylvania's Department of Environmental Protection unofficially estimated that between 82 and 140 million cubic yards of coal mining waste material is present in just the forty largest coal mining waste piles in northeastern Pennsylvania's anthracite region alone. See the article titled "Projects to Develop Electricity/F-T Diesel Co-Production Plants Move Forward" published in the March 2001 edition of Hart's Gas-To-Liquids News. Also see the articles titled "His Energy Answer Lies in Coal Industry's Waste" published on Apr. 11, 2001 in the Philadelphia Inquirer and "Coal-to-Oil Plant May Go Up by 2003, Santorum Backs Benefits for Region" published on Nov. 3, 2000 in The Pottsville (Pa.) Republican & Evening Herald. Also see an article published on the Internet and titled "Coal, The Fuel of America's Industrialization, The Fuel of America's Future".

U.S. Pat. Nos. 6,015,104 and 6,170,770 which issued to John W. Rich, Jr. discloses a process of utilizing coal mining waste to produce a liquid fuel. FIG. 1 of the above referenced patents schematically illustrates a process which includes a reactor vessel 100, known as an entrained flow gasifier, into which oxygen and a carbonaceous slurry is delivered, heated and mixed to generate a synthetic gas, known as raw syngas, and a crushed glass-like aggregate product. The raw syngas is cooled in a cooler 104, scrubbed of fine particulate in a cyclone apparatus 106 and then subjected to a sulfur removing process in apparatus 108. These steps transition the raw syngas into a so-called clean syngas which is input into a slurry phase vessel 110 where the clean syngas is combined with catalysts to yield a wax-like substance referred to as parafin. The parafin is processed to create a range of ultra-clean liquid fuels which are low in particulate, low in aromatics, and substantially free of sulfur and nitrogen, while having a high cetane (ie., energy density) number.

A problem with combining the above referenced gasification and liquefaction technologies is that the synthetic gas delivered into the liquefaction slurry phase vessel must be extremely pure and of a high quality for the liquefaction process to proceed in a superior manner. To this end, any sulfur or hydrogen sulfide present in the synthetic gas will react with the catalyst in the slurry phase vessel and prevent the process from yielding the desired output.

Therefore, there is a need for a method and apparatus which enables the technologies of coal gasification and coal liquefaction to be jointly utilized for generating ultra clean fuels from coal mining waste material. The process and apparatus should include a means of properly conditioning the raw syngas from the gasifier such that it can be effectively utilized to produce ultra clean, sulfur free fuels.

OBJECTS OF THE INVENTION

With the foregoing in mind, a primary object of the present invention is to provide a novel process and apparatus for producing ultra clean liquid fuel from coal mining waste material.

Another object of the present invention is to combine the technologies of coal gasification and coal liquefaction in a manner which enables efficient production of ultra clean fuels from coal mining waste material.

A further object of the present invention is to properly condition the syngas output from a gasifier so that it can be effectively utilized by coal liquefaction equipment to produce ultra clean sulfur free fuels.

DETAILED DESCRIPTION OF THE PREFERRED METHOD AND APPARATUS

Figure 1:
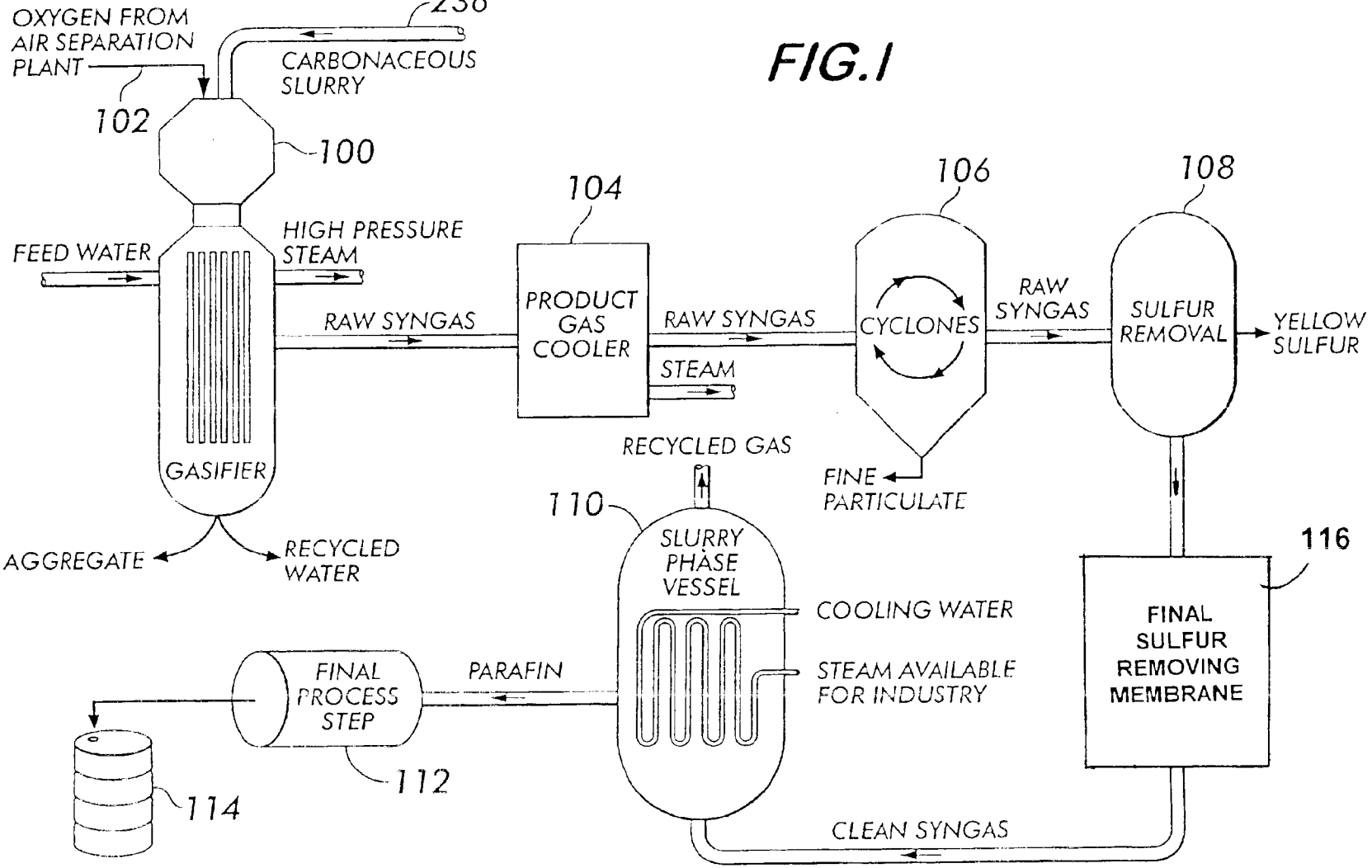
FIG. 1 illustrates schematically a coal gasification and liquefaction plant according to the present invention.

FIG. 1 illustrates schematically a coal gasification/liquefaction process which is utilized for making ultra clean liquid fuels, such as, ultra clean sulfur-free diesel fuel. The process preferably utilizes abandoned coal mine waste to produce a slurry of carbonaceous material that is ultimately transformed into a liquid fuel. Alternatively, carbonaceous material from other sources can be utilized to produce the slurry. An apparatus and method for preparing the carbonaceous slurry is disclosed in U.S. Pat. Nos. 6,015,104 and 6,170,770 issued to Rich, Jr., the disclosure of which are incorporated herein by reference.

Oxygen from an air separation plant (not shown) and the carbonaceous slurry are admitted into a coal gasification reaction vessel, preferably an entrained flow gasifier, 100 for reaction. In FIG. 1, the carbonaceous slurry is fed via piping 236 and the oxygen is fed via conduit 102 into the gasifier 100. In the gasifier 100, the coal and water slurry is mixed with oxygen and heated to produce an inert aggregate that resembles crushed brown glass and a synthetic gas ("raw syngas") containing a mixture of carbon monoxide and hydrogen. The aggregate is removed and can be used in products such as concrete, mortar, plaster and cinder blocks.

Before the syngas is permitted to flow into liquefaction equipment, the raw syngas is subjected to conditioning to ensure that the syngas is of proper purity and quality that is preferred by the liquefaction equipment. To this end, the raw syngas is cooled in a "Product Gas Cooler" 104 and then scrubbed of fine particulates in the "Cyclones" apparatus 106. Thereafter, commercial grade sulfur is removed from the raw syngas in the "Sulfur Removal" apparatus 108. However, the above referenced steps alone cannot remove all the sulfur and hydrogen sulfide in the syngas required for efficient processing of the syngas in the liquefaction equipment.

Therefore, a novel aspect of the present invention is to provide an additional sulfur polishing step to ensure that there is virtually no hydrogen sulfide, or sulfur, remaining in the syngas that, if present, would react with the catalyst in the liquefaction equipment and prevent the efficient production of ultra clean liquid fuel. To this end, the syngas output from the first sulfur removing apparatus 108 is purified, cleaned, and or polished in one further separate step to remove sulfur and obtain virtually pure clean syngas containing substantially no sulfur.

A final sulfur removing apparatus 116 preferably includes a zinc oxide membrane which is utilized to perform a final washing of the raw syngas before the raw syngas is processed into the liquefaction equipment. The final sulfur removing apparatus ensures that the syngas is pure and contains virtually no sulfur.

Thereafter, the resulting "clean syngas" output from the final sulfur removal apparatus 116 is directed into a "Slurry Phase Vessel" 110, where the pure syngas is combined with catalysts and yields a wax-like substance, "Parafin". As stated above, the catalyst is preferably cobalt based or iron based, and preferably the clean syngas gas stream contains virtually no sulfur and/or hydrogen sulfide that would undesirably react with the catalysts.

The parafin is processed at location 112 to create a range of ultra-clean liquid fuels. At tank 114, the liquid fuel is low in particulate, low in aromatics, and free of sulfur and nitrogen, while having a high Cetane (energy density) Number. For instance, the liquid fuel can be ultra clean sulfur-free diesel fuel.

The above described process and apparatus function efficiently to produce a ultra clean liquid fuel from a carbonaceous slurry made of waste coal mining material. The additional step of providing a final sulfur polishing/washing step enables the coal gasification and coal liquefaction technologies to be effectively coupled to produce the ultra clean fuel.

While a preferred method and apparatus have been described in detail, various modifications, alterations, and changes may be made without departing from the spirit and scope of the method and apparatus according to the present invention as defined in the appended claims.

What is claimed is:

1. A process for producing liquid fuel from a carbonaceous slurry, comprising the steps of:

admitting the carbonaceous slurry and oxygen into an entrained flow gasifier to produce a raw synthetic gas;

removing sulfur from said raw synthetic gas in a sulfur removing apparatus such that a pure synthetic gas is output from the sulfur removing apparatus and contains no more than trace amounts of sulfur;

after said sulfur removing step, flowing said raw synthetic gas through a zinc oxide membrane to remove said trace amounts of sulfur from said raw synthetic gas:

flowing said pure synthetic gas into a slurry phase vessel having a catalyst to produce a paraffin; and producing an ultra-clean, sulfur-free liquid diesel fuel from said paraffin.

2. A process according to claim 1, wherein said catalyst is an iron based catalyst.

3. A process according to claim 1, wherein said catalyst is a cobalt based catalyst.

4. A process according to claim 1, further comprising the steps of cooling said raw synthetic gas and removing particulate therefrom.

5. A process for producing liquid fuel from a carbonaceous slurry, comprising the steps of:

admitting the carbonaceous slurry and oxygen into an entrained flow gasifier to produce a raw synthetic gas;

cooling said raw synthetic gas;

removing particulate from said raw synthetic gas;

removing sulfur from said raw synthetic gas in a first sulfur removal step;

after said first sulfur removing step, flowing said raw synthetic gas through a zinc oxide membrane to remove any remaining sulfur from said raw synthetic gas in a final sulfur removal step to provide a clean synthetic gas which contains substantially no sulfur; and flowing said clean synthetic gas into a slurry phase vessel having a cobalt-based or iron-based catalyst to produce a parafin which is thereafter utilized to produce an ultra clean, sulfur-free liquid diesel fuel.

* * * * *